US006650054B2

(12) United States Patent
Higashi et al.

(10) Patent No.: US 6,650,054 B2
(45) Date of Patent: Nov. 18, 2003

(54) HIGH-PRESSURE DISCHARGE LAMP AND ARC TUBE WITH LONG OPERATING LIFETIME AND HIGH IMPACT RESISTANCE

(75) Inventors: Masanori Higashi, Takatsuki (JP); Yoshiharu Nishiura, Otsu (JP); Takashi Maniwa, Takatsuki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 64 days.

(21) Appl. No.: 10/011,356

(22) Filed: Nov. 6, 2001

(65) Prior Publication Data

US 2002/0079841 A1 Jun. 27, 2002

(30) Foreign Application Priority Data

Nov. 7, 2000 (JP) ..... 2000-338665

(51) Int. Cl.[7] ..... H01J 17/18
(52) U.S. Cl. ..... 313/623
(58) Field of Search ..... 313/623, 625, 313/634, 491, 493

(56) References Cited

U.S. PATENT DOCUMENTS 5,424,609 A 6/1995 Geven et al.
5,552,670 A * 9/1996 Heider et al. ..... 313/625

FOREIGN PATENT DOCUMENTS

EP 1006560 A2 7/2000
EP 1006560 A3 12/2001

* cited by examiner

*Primary Examiner*—Ross Gushi

(57) ABSTRACT

A high-pressure discharge lamp having an arc tube that includes a main tube part and a pair of capillary tube parts is provided. The main tube part includes a pair of electrodes and a metal halide enclosed, and the pair of capillary tube parts is arranged at the of the main tube part. The pair of capillary tube parts is sealed by means of a seal member to a different one of the feeders, and supplies electricity to each of the electrodes. At least one of the feeders includes a first conductive member that is resistant to halides and sealed to the capillary tube part, and a second conductive member that is connected to the first conductive member outside the capillary tube part and fixed at an outer end of the capillary tube part by means of the seal member.

26 Claims, 13 Drawing Sheets

HIGH-PRESSURE DISCHARGE LAMP AND ARC TUBE WITH LONG OPERATING LIFETIME AND HIGH IMPACT RESISTANCE

BACKGROUND OF THE INVENTION (1) Field of the Invention

The present invention relates to a high-pressure discharge lamp and an arc tube built in the high-pressure discharge lamp.

(2) Related Art

As an example of conventional high-pressure discharge lamps, there is a known metal halide lamp that is disclosed in the Japanese Laid-Open Patent Application No. H06-196131.

This metal halide lamp includes an arc tube having a main tube part and a pair of capillary tube parts. The main tube part has a pair of electrodes arranged opposite to each other in an internal discharge space. The pair of capillary tube parts is disposed at both ends of the main tube part and continues into the discharge space. In each of the capillary tube parts, there arranged a rod-like feeder for providing a current the corresponding electrode carries from outside. The feeder is sealed to the capillary tube part with a seal member such as frit glass.

The feeder consists of two different types of metal which are connected into a rod. That is to say, a metal with high halogen resistance, such as tungsten, is used in one part of the feeder extending from the inner electrode to the middle of a capillary tube part, and niobium, whose thermal expansion coefficient is closer to that of the seal member, is used for the other part of the feeder extending from the middle to outside. Only the niobium portion of the feeder is sealed with the seal member.

According to the above application, having such a sealing structure prevents corrosion of the part of the feeder which is exposed to halides the discharge space, since that part of the feeder is made of tungsten which is highly resistant to halides. Also, no crack will be produced due to thermal stress, since the feeder is sealed with the seal member at the niobium portion and niobium has a thermal expansion coefficient approximate to those of the seal member and the capillary tube part. This extends the lamp life substantially.

However, it was found in the actual fact that a leak of halides can occur in the sealed area even with the stated construction, which makes it impossible to ensure a sufficient lamp life.

Which is to say, though the niobium portion of the feeder arranged in the capillary tube part is covered with the seal member, as the temperature inside the capillary tube part rises to as high as several hundreds of degrees in the centigrade scale, the reaction between the metal halides and frit glass which is used as the seal member tends to occur, making the frit glass degenerated and weaker. As a result, every time the light is turned on and off, micro cracks are formed in the frit glass, in an area extending from the end of the seal member on the side of the discharge space to the other end of the feeder.

The occurrence of such cracks does not cause a leakage of the metal halides. However, since niobium is easily corroded by halides, corrosion can advance at a brush, once the halides that are penetrating into those micro cracks reach the surface of the niobium. This results in the occurrence of a space in places where niobium contacts with the seal member, causing a leak of metal halides enclosed inside the seal member, thereby rapidly decreasing luminous efficacy of the lamp.

Another metal halide lamp is devised that uses as a feeder only a conductive cermet, which is a sintered mixture of tungsten and alumina, instead of using two types of metals of different properties as described above.

However, this material is of low mechanical strength, and a portion of the conductive cermet that is protruding from a capillary tube part is easily broken by external impact and vibration.

A typical metal halide lamp is constructed in which a part of each feeder, which is protruding from an end of an arc tube, is connected to a feeding stem wire fixed to a base, so as to hold the arc tube to the base by means of the feeding stem wires. Therefore, if the protruding part is broken by external impact, the metal halide lamp becomes unusable.

High-pressure discharge lamps other than metal halide lamps also contain some kinds of halides to extend a lamp life by using halogen cycle. Therefore, the above problem can occur in these high-pressure discharge lamps, too.

SUMMARY OF THE INVENTION

In view of the above problems, it is an object of the present invention to provide a high-pressure discharge lamp that is not easily broken by external impact or vibration and can operate longer hours of time, by preventing halides from corroding into a feeder. Another object of the present invention is to provide an arc tube built in the high-pressure discharge lamp.

To achieve the first object, a high-pressure discharge lamp having an arc tube is provided. The arc tube includes an arc vessel having a main tube part and a pair of capillary tube parts, the main tube part having an inner discharge space, the capillary tube parts continuing into the discharge space; a pair of electrodes being opposed to each other in the discharge space: a pair of feeders, each of which is inserted through a different one of the capillary tube parts with an end connected to one of the electrodes on a side of the feeder and a remaining end protruding from the capillary tube part to outside; and a seal member for sealing the feeders in the capillary tube parts, wherein at least one of the feeders includes a first conductive member being sealed in the capillary tube part and a second conductive member being connected to the first conductive member outside the capillary tube part, the first conductive member being resistant to halides, the second conductive member being fixed with a fixing member at an end of the capillary tube part.

With the stated construction, a portion of the first conductive member of at least one of the feeders that is located inside the capillary tube part is halogen-resistant, which reduces the possibility of the feeder being corroded by halides that have penetrated in the seal member during the lighting. This prevents an enclosed substance from being leaked to outside. Also, the feeder has a second conductive member located outside the capillary tube part, which is different from the first conductive member. With the use of a material that has a great mechanical strength or is flexible, and with the second conductive member being fixed with a fixing member, it is possible to prevent a breakage of the feeder on external impact or vibration, thereby extending the lamp life.

The fixing member which is the seal member. With the stated construction, the sealing member used to seal the capillary tube part can also be used to fix the second conductive member to the capillary tube part, thus streamlining the manufacturing processing.

The high-pressure discharge lamp is provided with the fixing member so as to at least partially cover a connecting portion where the first conductive member is connected with the second conductive member. With the stated construction, it is possible to fix the second conductive member to the capillary tube part while increasing the mechanical strength of the connecting portion where the first conductive member is connected with the second conductive member.

The high-pressure discharge lamp is provided with the fixing member so as to completely cover a connecting portion where the first conductive member is connected with the second conductive member. With the stated construction, the mechanical strength of the connecting portion is further increased.

Note that the expression 'the connecting portion where the first conductive member and the second conductive member is connected' refers not only to a portion where they are connected mechanically in actual terms by laser welding or resistance welding, but also a portion where the first conductive member contacts to the second conductive member.

The high-pressure discharge lamp is provided with a connecting portion where the first conductive member is connected to the second conductive member in a vicinity of the end of the capillary tube part. With the stated construction, the second conductive member is located close to the capillary tube part, thereby reducing the amount of the fixing member required to fix the second conductive member to the capillary tube part.

The high-pressure discharge lamp is provided with the first conductive member and the second conductive member connected so that ends of the first conductive member and the second conductive member are placed side by side. With the stated construction, the size of a contact area where the first conductive member electrically contacts to the second conductive member is increased, and the welding of the first and the second conductive members into such a rod-like shape is easier than welding them into a straight rod.

The high-pressure discharge lamp is provided with an end surface of the second conductive member facing the first conductive member substantially so as to contact an end surface of the capillary tube part, and an inner diameter D(mm) of the capillary tube part, an outer diameter d1 (mm) of the first conductive member, and an outer diameter d2 (mm) of the second conductive member satisfy, $d1+d2>D$ . With the stated construction, the second conductive member can be used as a stopper, making it easier to determine the location of the electrodes in the main tube part during the manufacture.

The high-pressure discharge lamp is provided so that at least an end of the second conductive member facing the first conductive member has a cylindrical shape, and the first conductive member is inserted into the cylindrical part of the second conductive member to be connected to the second conductive member. With the stated construction, the mechanical strength of the connecting portion where the first conductive member is connected to the second conductive member is increased, and a breakage of the feeder due to external impact or vibration can be prevented with considerable effectiveness. Also, a contact area where the first conductive member contacts to the second conductive member is increased in size, so that electrical connection between the two members is ensured.

The high-pressure discharge lamp is provided so that a cylindrical end surface of the second conductive member facing the first conductive member is provided substantially in contact with an end surface of the capillary tube part, and an inner diameter D(mm) of the capillary tube part and an outer diameter d3 (mm) of the cylindrical portion satisfy, $d3>D$. With the stated construction, the second conductive member can be used as a stopper, serving to determine the location of the electrode in the main tube part during the manufacture.

The high-pressure discharge lamp is provided so that a cylindrical end surface of the second conductive member facing the first conductive member is provided substantially in contact with an end surface of the capillary tube part, and an incision part is provided at an end of the cylindrical part of the second conductive member, the incision part allowing for a connection between an inner space and outside, the inner space being situated between the capillary tube part and the first conductive member. With the stated construction, a melted seal member can flow through the incision part into a space between the capillary tube part and the first conductive member, ensuring the sealing processing.

The high-pressure discharge lamp is provided so that a cylindrical end surface of the second conductive member facing the first conductive member is provided substantially in contact with an end surface of the capillary tube part, and an incision part is provided at an end of the capillary tube part, the incision part allowing for a connection between an inner space and outside, the inner space being situated between the capillary tube part and the first conductive member. With the stated construction, the same effects can be achieved as in the case where the incision part is provided in the first conductive member.

The high-pressure discharge lamp includes a fringe at a cylindrical end of the second conductive member facing the first conductive member, the fringe being placed substantially in contact with an end surface of the capillary tube part. With the stated construction, the feeder is securely supported by the fringe and can withstand to impact on the second conductive member perpendicular to the longitudinal direction of the second conductive member. This further reduces the possibility of the feeder being broken off.

The fringe has a thickness of 0.2 mm to 1.0 mm. With the stated construction, the fringe is strong enough to be used for a backup use, which further reduces the possibility of the feeder being broken off.

The high-pressure discharge lamp includes a taper at the cylindrical end of the second conductive member facing the first conductive member, the taper flaring towards the first conductive member, an end of the taper substantially contacts to an end surface of the capillary tube part. With the stated construction, the feeder is firmly supported by the taper and can withstand to impact on second conductive member in a direction perpendicular to the longitudinal direction of the second conductive member. This further reduces the possibility of the feeder being broken off.

The high-pressure discharge lamp includes a ringed member through which the second conductive member is inserted, wherein the ringed member is provided substantially in contact with the end surface of the capillary tube part and fixed to the second conductive member and an end surface of the capillary tube part with the fixing member. With the stated construction, the ringed member is attached to the second conductive member to fix the feeder to the capillary tube part firmly. This further reduces the possibility of the second conductive member being broken off.

The high-pressure discharge lamp is provided wherein the so that the first conductive member is connected to the second conductive member so that the first conductive member is arranged perpendicular to the second conductive member longitudinally. With the stated construction, the high-pressure lamp becomes shorter in length than in the case where the ends of the first conductive member and the second conductive member are placed in parallel.

The high-pressure discharge lamp is provided so that a difference in a thermal expansion coefficient between the first conductive member and the seal member is equal to or smaller than a difference in the thermal expansion coefficient between tungsten and the seal member. With the stated construction, there is a reduction in the level of thermal stress generated during the lamp operation between the first conductive member and the seal member due to a difference in thermal expansion coefficient. As a result, the possibility of the occurrence of a crack in the seal member is further reduced.

It is preferable that the first conductive member is made of a conductive cermet. Since the conductive cermet has a thermal expansion coefficient approximate to that of frit glass which is used commonly as a seal member, the conductive cermet can more effectively prevent the occurrence of a crack produced by thermal stress.

The high-pressure discharge lamp is provided so that the second conductive member is chiefly made of niobium. Niobium has a greater mechanical strength than the first conductive member, which is generally resistant to halides, and has a thermal expansion coefficient closer to that of the seal member. The use of the seal member as a fixing member therefore does not lead to the occurrence of a crack at a supporting point of the sealed area, increasing the mechanical strength of the arc tube considerably.

To achieve the second object of the present invention, the arc tube related to the present invention has an arc tube including an arc vessel including a main tube part and a pair of capillary tube parts, the main tube part having an inner discharge space, the capillary tube parts continuing into the discharge space; a pair of electrodes being opposed to each other in the discharge space: a pair of feeders, each of which is inserted through a different one of the capillary tube parts with an end connected to one of the electrodes on a side of the feeder and a remaining end protruding from the capillary tube part to outside; and a seal member for sealing the feeders in the capillary tube parts, wherein at least one of the feeders includes a first conductive member being sealed in the capillary tube part and a second conductive member being connected to the first conductive member outside the capillary tube part, the first conductive member being resistant to halides, the second conductive member being fixed with a fixing member at an end of the capillary tube part. With the stated construction, a portion of the first conductive member of at least one of the feeders that is located inside the capillary tube part is halogen-resistant, which reduces the possibility of the feeder being corroded by halides that have penetrated in the seal member during the lighting. This prevents an enclosed substance from being leaked to outside. Also, the feeder includes a second conductive member located outside the capillary tube, which is different from the first conductive member. With the use of a material that has a greater mechanical strength or flexibility, and by fixing the second conductive member to the capillary tube part by means of a suitable fixing member, the breakage of the feeder on external impact or impact can be prevented, and thus an arc tube having a longer operating lifetime can be obtained.

BRIEF DESCRIPTION OF THE DRAWINGS

These and other objects, advantages and features of the invention will become apparent from the following description thereof taken in connecting portion with the accompanying drawings which illustrate specific embodiments of the invention.

In the drawings.

DESCRIPTION OF PREFERRED EMBODIMENTS

The following describes embodiments of the present invention, with reference to the accompanying drawings.

(First Embodiment)

The Constructions of an Arc Tube and a Metal Halide Lamp

Figure 1:
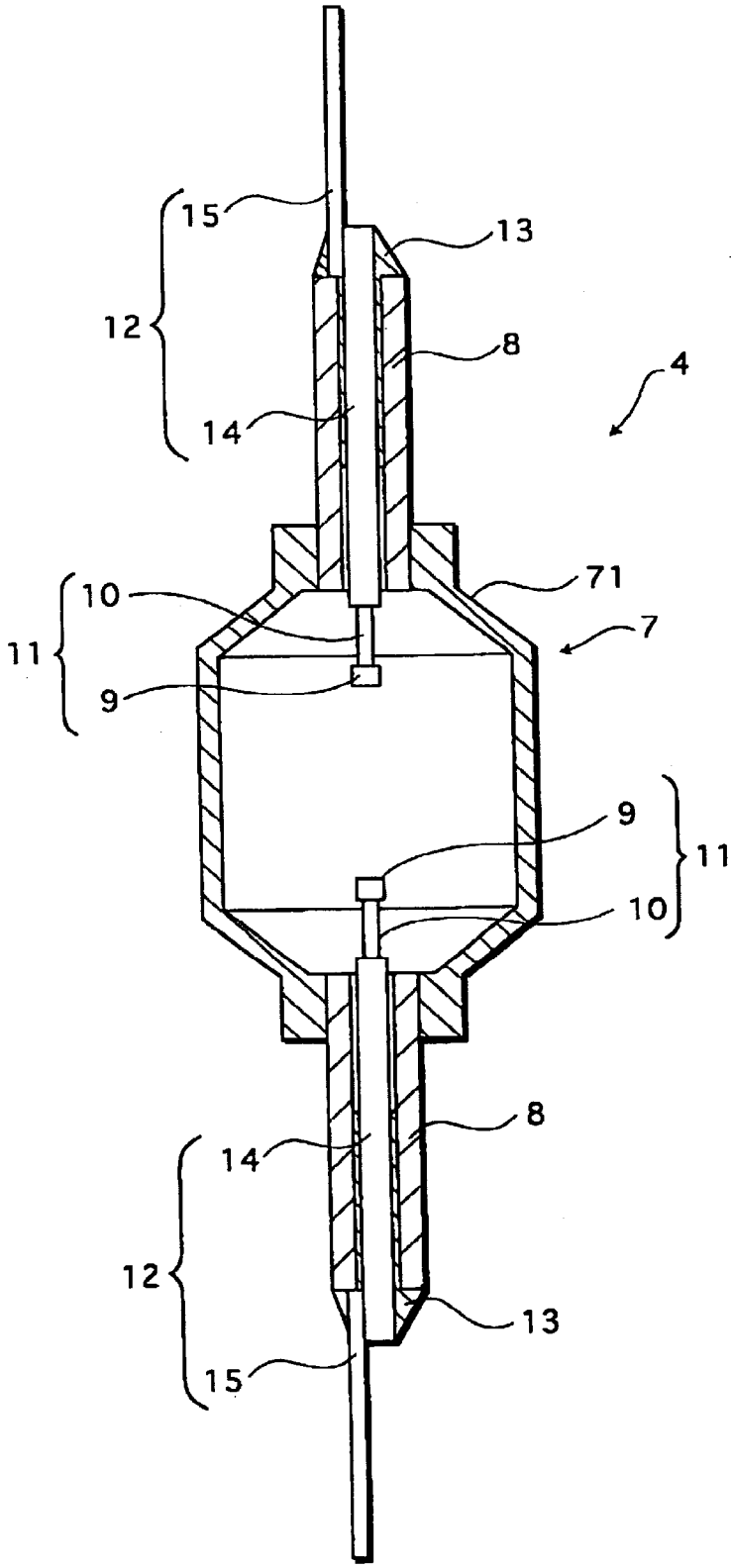
FIG. 1 is a front view in cross section, of an arc tube that is used for a metal halide lamp, which is the first embodiment of the present invention.

FIG. 1 is a sectional view showing the construction of an arc tube 4 of a metal halide lamp of the first embodiment.

A vessel containing the arc tube 4, which is an arc vessel, is a ceramic vessel that is made of alumina (whose thermal expansion coefficient is $8.1\times10^{-6}$), and has a main tube part 71 with an inner volume of 1.1 $cm^3$, and a pair of cylindrical capillary tube parts 8 arranged at the ends of the main tube part 71.

The emission part 7 of the arc tube 4 includes, inside an internal discharge space of the main tube part 71, a predetermined metal halide and a pair of opposing electrodes 11. In the capillary tube part 8, a first conductive member 14 of a feeder 12 is sealed with a seal member 13.

The feeder 12 has the first conductive member 14 and the second conductive member 15, which are arranged side by side, and the end of the first conductive member 14 and the second conductive member 15 are connected by laser welding and resistance welding in the vicinity of an end surface of the capillary tube part 8. The seal member is supplied so as to cover the connecting portion. An end of the first conductive member 14, which is penetrating into the discharge space, is connected to an electrode rod 10 of the electrode 11, so that the electrode 11 is fixed at a predetermined position in the discharge space and provided with an electric current. More detailed explanation of the materials for the first conductive member 14, the second conductive member 15 and the sealing structure in the feeder 12 will be given later.

Figure 2:
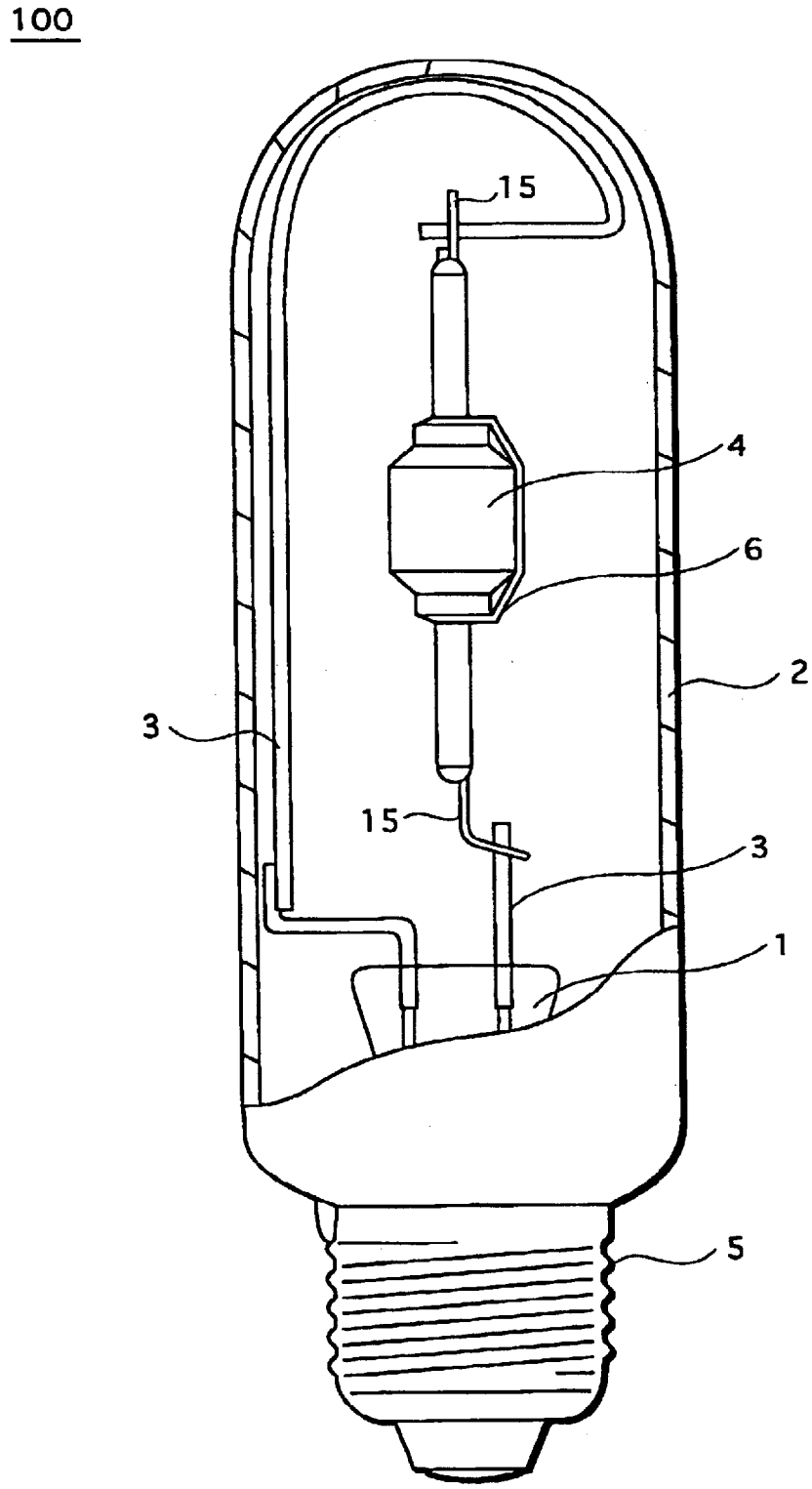
FIG. 2 is a front view, with portions broken away for the sake of clarity, of the metal halide lamp having the arc tube of FIG. 1.

FIG. 2 is a view, with portions broken away, of a metal halide lamp 100 having the arc tube 4.

The metal halide lamp 100, which has a rated wattage of 150 W, a total length of 140 mm and the outer diameter of 40 mm, includes an outer tube 2 with one end being closed and the other end being sealed by a stem 1. Referring to FIG. 2, two Monel stem wires 3 extend towards the inside of the outer tube 2 though the stem 1, and the second conductive members 15 of the arc tube 4 are connected to the stem wires 3.

A base 5 is provided at the place where the outer tube 2 is sealed with the stem 1. Also, a predetermined volume of nitrogen gas is enclosed in the outer tube 2, in order to prevent the occurrence of discharge in the outer tube 2 due to a possible leakage in the arc tube 4. The reference numeral 6 refers to a known vicinity conductor that is used to start the lamp operation.

In the thus constructed metal halide lamp 100, electricity is provided through the base 5 to the electrode 12 in the arc tube 4 by means of the stem wire 3, to lit the arc tube 4.

The Construction of the Feeder 12 and Sealing Structure

The following describes in more detail the construction of the feeder 12 and the sealing structure in the capillary tube part 8.

Figure 3:
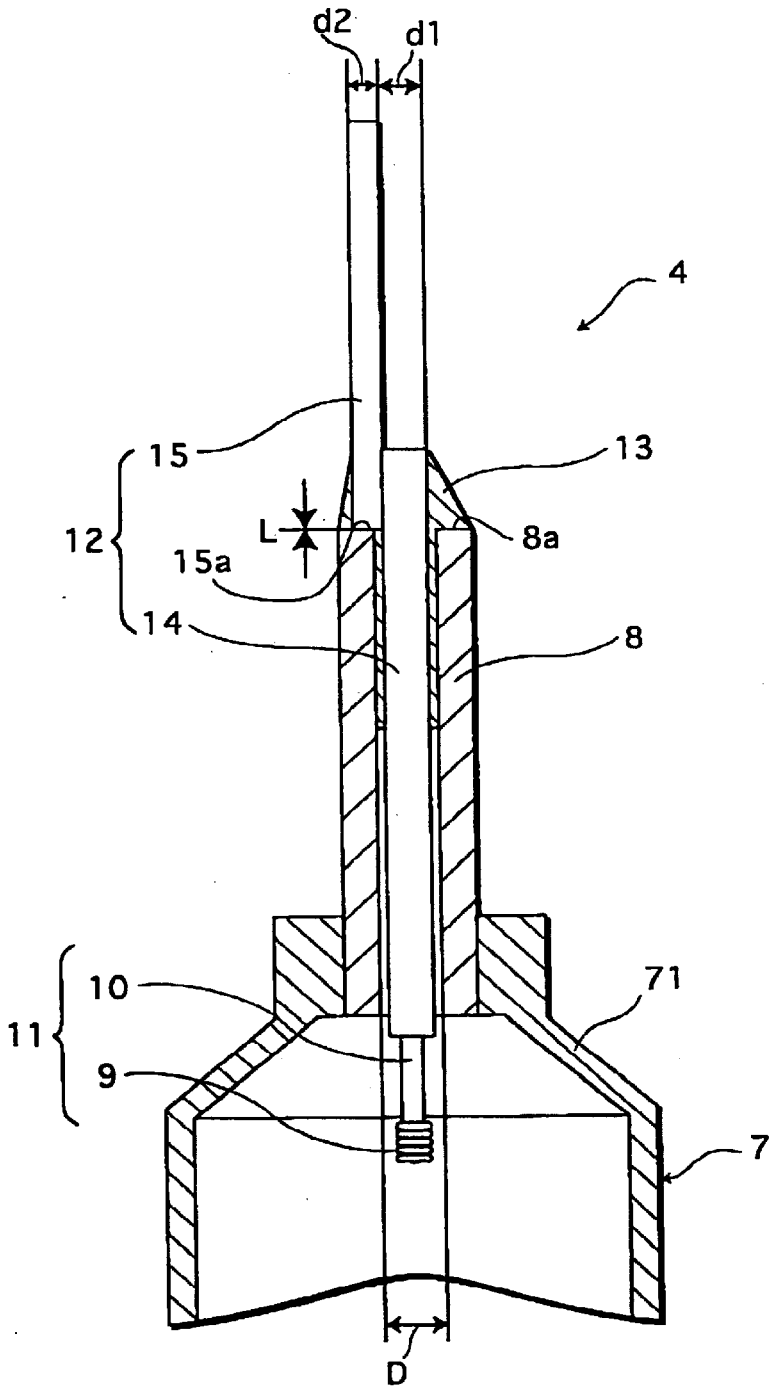
FIG. 3 is an enlarged view in cross section of main parts of the arc tube of FIG. 1.

FIG. 3 is an enlarged view in cross section of one end of the arc tube 4. The electrode 11, arranged in the internal discharge space of the main tube part 71, includes the tungsten electrode rod 10 and a coil part 9. The coil part 9 is formed by attaching a coil to the tip of the electrode rod 10, the coil being formed by winding a tungsten wire. Both of them usually contain a small amount of kalium and other impurities.

In the main tube part 7, there enclosed are predetermined amounts of (a) metal halides, such as dysprosium iodide ($DyI_3$) and sodium iodide (NaI), (b) mercury as a buffer, and (c) argon gas, neon gas, a mixture of them and other rare gases as starting gases.

Inside the capillary tube part 8, the feeder 12 for supplying electricity to the electrode 11 is sealed with the seal member 13, such as frit glass (with a thermal expansion coefficient of $6\times10^{-6}$ to $7\times10^{-6}$). The seal member 13 is introduced through a space between the capillary tube part 8 and the first conductive member 14 of the feeder 12, as described later, to an area 4 mm to 6 mm away from an end surface of the capillary tube part 8. The size of the space is within a range of 0.05 mm to 0.07 mm.

The feeder 12 includes the first conductive member 14 and the second conductive member 15. The first conductive member 14 is a 20 mm-long, rodded and halogen-resistant conductive cermet which is a sintered mixture of molybdenum and alumina (with the proportion of molybdenum and alumina 50% to 50%, by weight). The second conductive member 15 is a 20 mm-long, rodded and heat-resistant substance, mainly composed of niobium, and has a greater mechanical strength than a conductive cermet. The first and the second conductive members are electrically connected by resistance welding or laser welding, so that their longitudinal shaft centers are placed in parallel, but not in a straight line. In other words, the ends of them are arranged side by side.

Accordingly, a contact area where the first conductive member 14 electrically contacts with the second conductive member 15 increases in size. This improves their credibility as a feeder. Also, it is easier to weld them into such a rod-like shape than to weld the first conductive member 14 and the second conductive member 15 into a straight rod.

As a material for the first conductive member 14, it is preferable to use the above conductive cermet whose thermal expansion coefficient is approximate to those of the capillary tube part 8 and the seal member 13. But this conductive cermet may be replaced with a conductive cermet having 40% of molybdenum and 60% of aluminum by weight, or a conductive cermet made of a sintered mixture of tungsten and aluminum. Tungsten may also be used as a material for the first conductive member 14.

As a material for the second conductive member 15, it is preferable to use niobium, which is thermal-resistant, flexible and has a thermal expansion coefficient approximate to the thermal expansion coefficient of the seal member 13. Other metals, such as tantalum, titanium, molybdenum and zirconium, may also be used. Obviously, the second conductive member 15 must be a heat-resistant metal so that it is not deformed as the temperature rises during the operation.

The second conductive member 15 is chiefly made of niobium and contains several weight percentage of zirconium.

The connecting portion of the first conductive member 14 and the second conductive member 15 is located outside the capillary tube part 8, being in the vicinity of an end surface of the capillary tube part 8, and is covered entirely with the seal member 13. Since the second conductive member 15 is fixed firmly at the end of the capillary tube part 8 by the seal member 13, and the connection between the first conductive member and the second conductive members is made stronger, it is less likely that the second conductive member 15 is broken off by external impact.

The first conductive member 14 protrudes from the capillary tube part 8 by about 3 mm. In the present invention, the seal member 13 covering the connecting portion of the first conductive member 14 and the second conductive member 15 is identical to and continuous to the seal member 13 that is introduced into the space between the capillary tube part 8 and the first conductive member 14.

By reducing the length of the protruding part of the first conductive member 14, the entire part of the first conductive member 14 (the 'entire part' here refers to a part excluding the contact area where the first conductive member 14 contacts to the second conductive member 15) can be covered with the seal member 13, even if there is a distance between the capillary tube part 8 and the connecting portion. This eliminates the possibility of the protruding part of the first conductive member 14 being broken off. However, when the capillary tube part 8 is located too far from the connecting portion, a larger amount of the seal member 13 is required. It is therefore preferable to set the shortest distance L at 0 mm to 5 mm, which is the distance between the end surface of the capillary tube part 8 and the connecting portion where the first conductive member 14 is connected with the second conductive member 15 (See FIG. 3). The shortest distance shown in FIG. 3 is set substantially at 0 mm.

The second conductive member 15 effectively contacts the end surface of the capillary tube part 8. Preferably, the inner diameter of the capillary tube part 8, D(mm), the outer diameter of the first conductive member 14, d1(mm) and the outer diameter of the second conductive member 15, d2(mm) (See FIG. 3) should satisfy, $d1+d2>D$.

In this way, the second conductive member 15 can be used as a stopper to determine the location of the electrode 11 in the main tube part 7 during the manufacture, which saves the need to provide the feeder with an additional stopper as has been required by a conventional manufacturing method. This results in the reduction in manufacturing cost, which improves production efficiency.

In this embodiment, the inner diameter D of the capillary tube part 8 is 1.0 mm, the outer diameter of the first conductive member 14 is 0.9 mm and the outer diameter of the second conductive member 15 is 0.5 mm. The diameter of the first conductive member 14 is uniform along the rod.

The expression "effectively contacts the end surface of the capillary tube part 8" refers to the case where the seal member 13 is provided in a layer with a thickness of several $\mu$m~100 $\mu$m between the capillary tube part 8 and the second conductive member 15, in addition to the case where the second conductive member 15 directly contacts the end surface of the capillary tube part 8.

Figure 4:
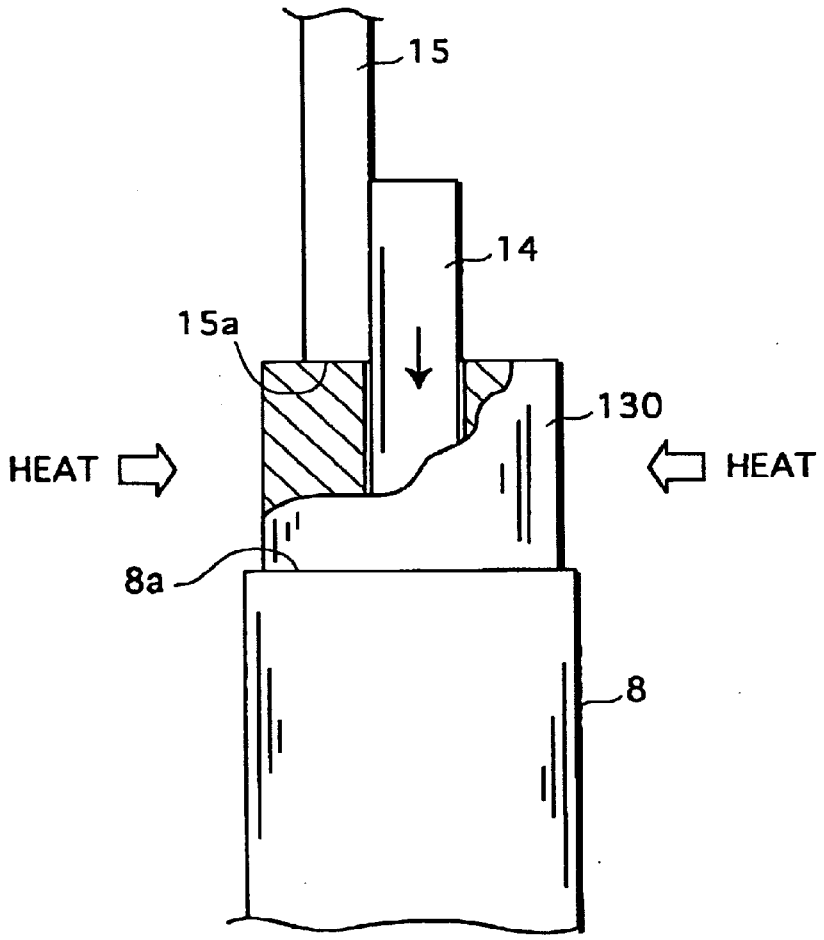
FIG. 4 is a view used to explain the sealing processing for the feeder.

FIG. 4 is a view, with portions broken away, which is used to explain the overview of a process of sealing the capillary tube part 8. The first conductive member 14 of the feeder 12 is inserted through a ringed frit glass block 130, and the electrode 11 that is connected to the tip of the first conductive member 14 is inserted into the capillary tube part 8 with an end to be closed facing upwards. As a result, the bottom surface of the ringed frit glass block 130 contacts to an end surface of the capillary tube part 8, as shown in FIG. 4, and an end surface 15*a* of the second conductive member 15 contacts the upside end surface of the frit glass block 130.

With a heater arranged around the frit glass block 130, the capillary tube part 8, in this position, is heated at around 1500°, at which the frit glass block 130 melts down and turns into a liquid. As a result, the feeder 12 falls by the pull of gravity, so that the end surface 15*a* comes in contact with an end surface 8*a* of the capillary tube part 8, which determines an exact location of the feeder 12 and the electrode 11.

Meanwhile, a capillary action occurs where a liquid frit glass infiltrates into a space between the inner surface of the capillary tube part 8 and the outer surface of the conductive member 14. Due to a surface tension, the liquid frit glass adheres to the connecting portion where the first conductive member 14 is connected to the second conductive member 15 and to the end surface 8*a* of the capillary tube part 8. The liquid frit glass hardens into the shape as shown in FIG. 3.

Though only one end surface of the arc tube 4 is illustrated in FIG. 3, the other end surface has exactly the same structure.

Testing

The following describes a test on such metal halide lamp 100 (hereafter referred to as 'invention A'), with an aim to find about properties of the lamp.

Firstly, ten units of invention A were manufactured, and a drop test was conducted on each of them, to see how many feeders 12 of them were broken.

In the drop test, a lamp included in a general light case was dropped perpendicularly from a point one-meter away from the floor so that the longitudinal axis of the lamp is laid in parallel to the floor.

For the sake of comparison, ten units of metal halide lamps with a rated wattage of 150 W (hereafter referred to as 'comparison A') were manufactured, to see how many of their feeders were broken under the same testing condition as in the test on invention A. These ten units of metal halide lamps have the same construction as the metal halide lamp of the first embodiment, which has a rated wattage of 150 W, except that the feeder is made only of a conductive cermet which is a mixture of tungsten and alumina (in proportion of 50% to 50%, respectively) and that a part of the feeder protrudes from the capillary tube part 8.

The result is that no feeders 12 of invention A were broken, while 8 out of 10 feeders of comparison A were broken. This means that the number of the feeders 12 of invention A that were broken by external impact or vibration was lower than the feeders of comparison A.

Another ten units of invention A were manufactured in the same way and lit, in order to find about lamp life properties.

In the life test, lighting was maintained for five and a half hours, followed by a thirty minutes of interval. Such a cycle was repeated until the lamp came to the end of the life. The expression 'operating life' in the following refers to a net total hours in which the lighting was maintained.

For the sake of comparison, ten units of metal halide lamps with a rated wattage of 150 W (hereafter referred to as 'comparison B') were manufactured, to see how many of their feeders were broken under the same testing condition as a test performed on the lamps of invention A. Such a metal halide lamp has the same construction as the metal halide lamp of the first embodiment which has a rated wattage of 150 W, except that the feeder is made of tungsten and niobium which are connected together into a rod, and that the connecting part where tungsten and niobium are connected, or a part of the niobium portion, is inside the capillary tube part 8.

In the lamp of comparison B, the niobium portion arranged inside the capillary tube part 8 is completely covered by the seal member 13. An end surface of the niobium portion on the side facing the discharge space is situated 2 mm away from an end surface of the seal member 13 on the side facing the discharge space.

The result is that all the lamps of invention A kept operating for more than 9000 hours. By contrast, 8 out of 10 lamps of comparison B kept operating for more than 9000 hours, and one of the 10 lamps kept operating for only 3000 hours. This is because the feeders 12 of invention A were not affected by the erosion by halides. Though the niobium portion of a lamp of comparison B was covered by the seal member 13, micro cracks appeared in the seal member 13, in an area extending from the end on the discharge space side towards the other end of the feeder. This is due to the fact that the seal member 13 was repeatedly heated and cooled every time the lamp was turned on and off. As a result, the halides gradually penetrated into spaces that were formed due to the micro cracks, causing erosion in the niobium feeder, thus leading to the occurrence of the leakage.

Note that the luminous efficacy, correlated color temperature and general color rendering index Ra of the lamps of invention A, comparison A and comparison B are 901 m/W, 4300K and 90, respectively.

With the stated construction, the metal halide lamp of the first embodiment has the feeder 12 including only the halogen-resistant first conductive member 14 in the capillary tube part 8, so that even if halides penetrate into a space between the capillary tube part 8 and the seal member 13 during the lamp operation, the feeder 12 is saved from the erosion by the halides. This prevents the occurrence of a possible leakage by the erosion, and as a result, the operating life can be extended. Further, the breakage of the feeder 12 on external impact and vibration can be prevented, since the portion of the feeder 12 arranged outside the capillary tube part 8 is made of the second conductive member 15 having a greater mechanical strength, the strength of the connecting portion is increased with the seal member 13 covering at least a part of the connecting portion where the first conductive member 14 is connected to the second conductive member 15.

Especially when the connecting portion where the first conductive member 14 is connected to the second conductive member 15 is completely covered by the seal member 13, the mechanical strength of the connecting portion is further increased.

(Second Embodiment)

A metal halide lamp of the second embodiment has the same structure except for a-feeder in the arc tube 4.

Figure 5:
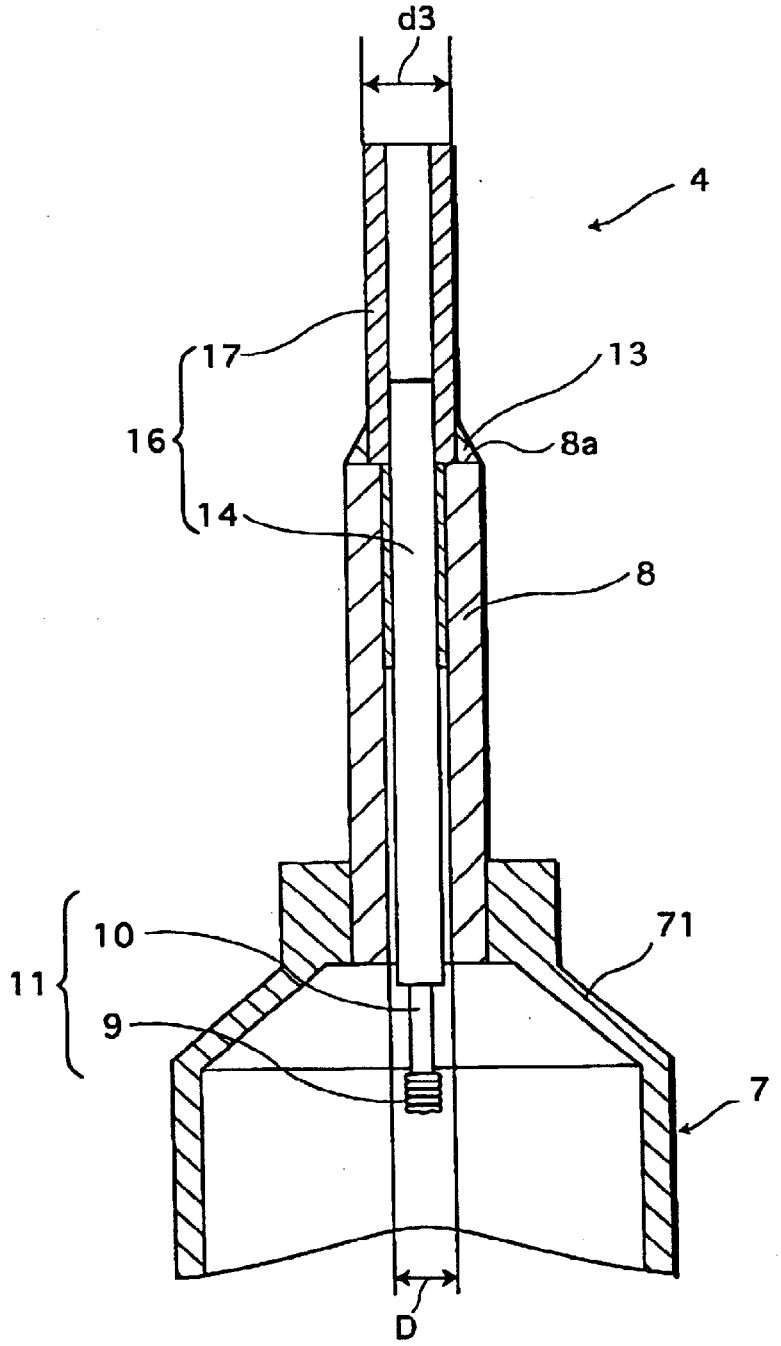
FIG. 5 is an enlarged view in cross section of main parts of an arc tube that is used for a metal halide lamp related to the second embodiment.

FIG. 5 is an enlarged cross-sectional view of a capillary tube part 8 of the arc tube 4 in the second embodiment.

Note that construction elements which are the same as those shown in FIG. 1 are given the same reference numerals, and their explanation is omitted here for the sake of convenience. The rest of the embodiments are described in the same manner.

Referring to FIG. 5, a second conductive member 17 of a feeder 16 is a niobium cylinder that is 20 mm long and has an inner diameter of 0.94 mm. One end of a first conductive member 14 that is protruding from the capillary tube part 8 by about 3 mm is arranged inside a second conductive member 17 and electrically connected to the second conductive member 17 by laser welding, or the like.

In the sealing processing described above, the connecting portion where the first conductive member 14 is connected to the second conductive member 17 is almost entirely covered by the seal member 13, so that the second conductive member 17 is supported securely by the capillary tube part 8.

The size of an area where the first conductive member 14 is connected with the second conductive member 17 is within a range of 2.8 $mm^2$ to 17 $mm^2$; it may be 8.5 $mm^2$, for instance.

The bottom surface of the second conductive member 17 substantially contacts to an end surface of the capillary tube part 8. It is preferable that the inner diameter D(mm)of the capillary tube part 8, (See FIG. 5) and the outer diameter d3 (mm) of the second conductive member 17, (See FIG. 5) satisfy, d3>D. In this embodiment, the inner diameter D of the capillary tube part 8 is set at 1.0 mm, and the outer diameter of the second conductive member 17 is set at 1.4 mm.

As a result, the second conductive member 17 can be used as a stopper to determine the location of the electrode 11 in the main tube part 7 during the manufacture effectively. This saves the need to provide an additional stopper to the feeder which was provided by conventional manufacturing methods, which reduces production cost and increases production efficiency.

Though only one end of the arc tube 4 is illustrated in FIG. 5, the other end has the same structure.

As described above, the first conductive member 14 of the feeder 16 of the metal halide lamp of the second embodiment that is placed inside the capillary tube part 8 is halogen-resistant. This being so, even if halides penetrate in between the capillary tube part 8 and the seal member 13 during the lamp operation, there is no risk of the feeder being eroded by halides. Therefore, it is possible to prevent the occurrence of leakage by halides, and thereby the operating life of the lamp is extended.

Further, a portion of the feeder 16 arranged outside the capillary tube part 8 which is the second conductive member 17 is made of niobium and has a greater mechanical strength than a conductive cermet, which is used as a material for the first conductive member 14. The first conductive member 14 is connected to the cylindrical second conductive member 17 inside the second conductive member 17, and the connecting portion where the first conductive member 14 is connected to the second conductive member 17 is at least partially covered by the seal member 13. As a result, the connecting portion is provided with a greater mechanical strength, which further reduces the possibility of the feeder 16 being broken off by external impact and vibration. Also, the size of the contact area where the first conductive member 14 contacts the second conductive member 17 is increased, ensuring electrical connection between them.

Particularly, when using resistant welding to connect the first conductive member 14 to the second conductive member 17, the size of the contact area increases, and as a result, resistance of the contact surface is reduced. This makes it easier to weld the first conductive member 14 and the second conductive member 17 together.

However, in order to have the cylindrical second conductive member 17 directly connected to the end surface of the capillary tube part 8, as in the metal halide lamp of the second embodiment, it may take time to introduce the liquid seal member 13 through a space of several $\mu$m between the capillary tube part 8 and the second conductive member 17 into a space between the capillary tube part 8 and the first conductive member 14. This might cause a decline in production efficiency.

It is therefore preferable to provide an incision part 17*b* on an end where the second conductive member 17*a* contacts the capillary tube part 8, which allows f or a connection between outside and a space between the capillary tube part 8 and the first conductive member 14.

As a result, the melted seal member 13 flows through the incision part 17*b* into the space between the capillary tube part 8 and the first conductive member 14 during the manufacture, which raises production efficiency.

Figure 7:
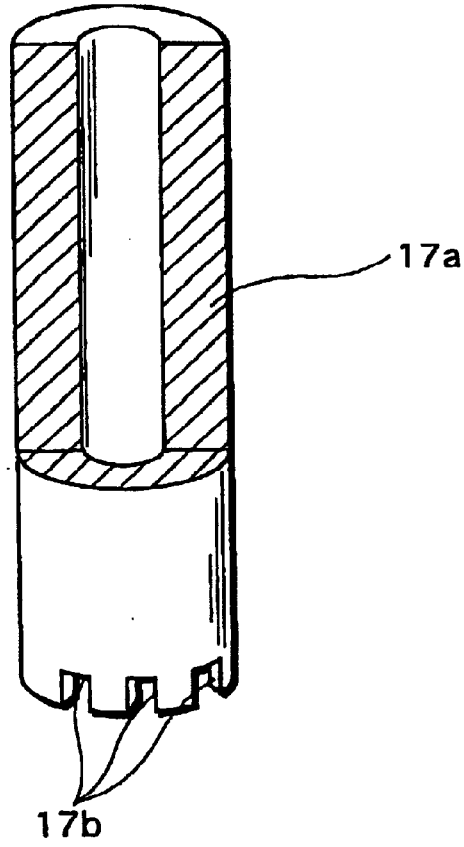
FIG. 7 is a perspective view, with portions broken away, of a second conductive member of FIG. 6.

FIG. 7 is a perspective view, with portions broken away, of the second conductive member 17*a*. In this example, three of incision part 17*b* are provided on the end surface of the second conductive member 17*a* that is facing towards the capillary tube part 8. Each of them has a depth of 0.2 mm to 1.0 mm and a width of 0.2 mm to 1.0 mm.

With an increased number of the conductive members 17*a* arranged on the bottom surface of the second conductive member 17*a* at a predetermined spacing along the circumference, the amount of the seal member 13 that is introduced in the circumference direction is equalized, which ensures the sealing for the first conductive member 14 and the capillary tube part 8.

Though not illustrated in any of the drawings, the same effects can be achieved by providing at the end of the capillary tube part 8 similar incisions that allow for a connection between outside and a space between the capillary tube part 8 and the first conductive member 14 to outside. As a result, melted seal member 13 is introduced smoothly into a space between the capillary tube part 8 and the first conductive member 14.

(Third Embodiment)

Figure 8:
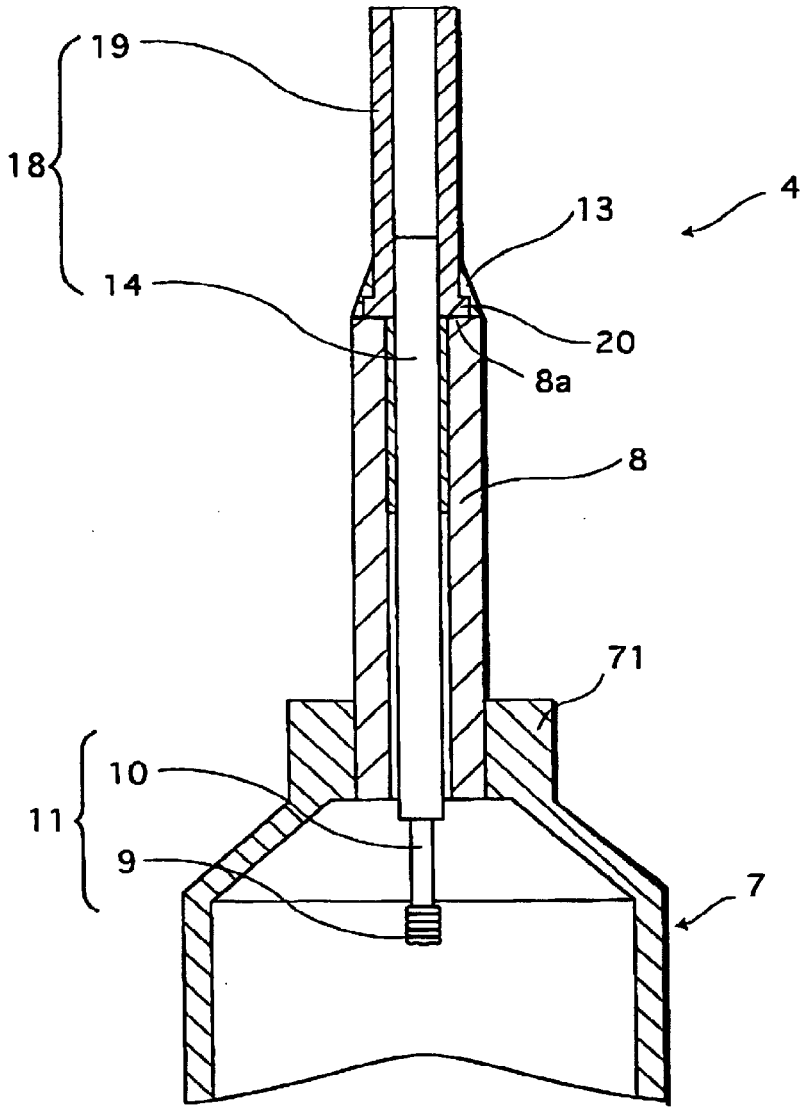
FIG. 8 is an enlarged view in cross section of main parts of a metal halide lamp of the third embodiment.

FIG. 8 is a cross-section showing the construction of one of the capillary tube parts 8 in the arc tube 4 in a metal halide lamp, which is the third embodiment.

Referring to FIG. 8, a feeder 18 includes a first conductive member 14, with one end inserted into a cylindrical second conductive member 19. The third embodiment differs from the second embodiment in that a fringe 20 is formed at the bottom of the second conductive member 19.

Figure 9:
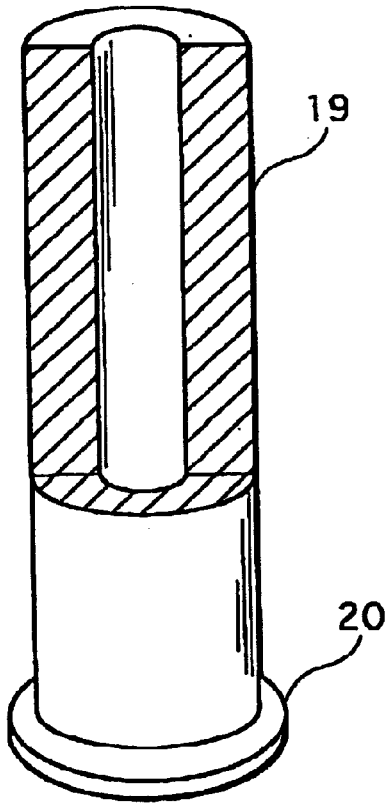
FIG. 9 is a perspective view, with portions broken away, of a second conductive member of the arc tube of FIG. 8.

FIG. 9 is a perspective view, with portions broken away, of the second conductive member 19.

Referring to FIG. 9, the fringe 20 is formed at the bottom of the cylindrical second conductive member 19. It is preferable that a diameter of the fringe 20 is smaller than 4.0 mm, which is an outer diameter of the capillary tube part 8, so that a liquid seal member 13, having melted during the sealing processing, is introduced into the upper side of the fringe 20. The example fringe 20 shown here has an outer diameter of 2.5 mm and a thickness of 0.5 mm.

Note that though only one end of the arc tube 4 is illustrated in FIG. 8, the other end has the same construction.

The connecting portion where the first conductive member 14 is connected to the second conductive member 19 is almost entirely covered by the seal member 13.

With the stated construction, the metal halide lamp of the third embodiment including the cylindrical second conductive member can achieve the same effects as in the case of the second embodiment, such as longer operating lifetime and resistance to impact. Also, with the presence of the fringe 20, which is provided at the end of the second conductive member 19 so as to substantially contacts to the end surface of the capillary tube part 8, it is less likely that the feeder 18 being broken by external impact and vibration in a direction vertical to the longitudinal direction of the second conductive member 19. This improves lamp's resistance to impact.

To further reduce the possibility of the feeder 18 being broken by impact and vibration in a direction vertical to the longitudinal center axis of the second conductive member 19, it is preferable that the fringe 20 should have a thickness in a range of 0.2 mm to 1.0 mm.

As a modified example of the metal halide lamp of the third embodiment, a ringed member 21 may be provided at the base of the second conductive member 19. The ringed member 21 substantially contacts the end surface of the capillary tube part 8, and fixed to the second conductive member 19 and the end surface of the narrow part 8 with the seal member 13.

The ringed member 21 may be formed of a ceramic material of alumina or YAG, and may have an outer diameter of 4.0 mm and a thickness of 2 mm to 3 mm.

The use of the ringed member 21 can reinforce the second conductive member 19, as does the fringe 20. The ringed member does not have to be conductive, which provides a wider choice of the material.

It is preferable that the outer diameter of the ringed member 21 should be smaller than the outer diameter of the capillary tube part 8, as in the case of the fringe 20 of FIG. 8. The outer diameter of the ringed member 21, though, may be somewhat larger than that of the capillary tube part 8 as shown in FIG. 10, as long as the liquid seal member 13 can reach an upper area of the ringed member 21 through the space between the ringed member 21 and the second conductive member 19.

The ringed member 21 may be made of a different material than ceramic, if it has a thermal expansion coefficient closer to that of the seal member 13. Examples of such material are niobium, tantalum, molybdenum, and a cermet of sintered mixture of alumina and tungsten or molybdenum and tungsten.

Figure 10:
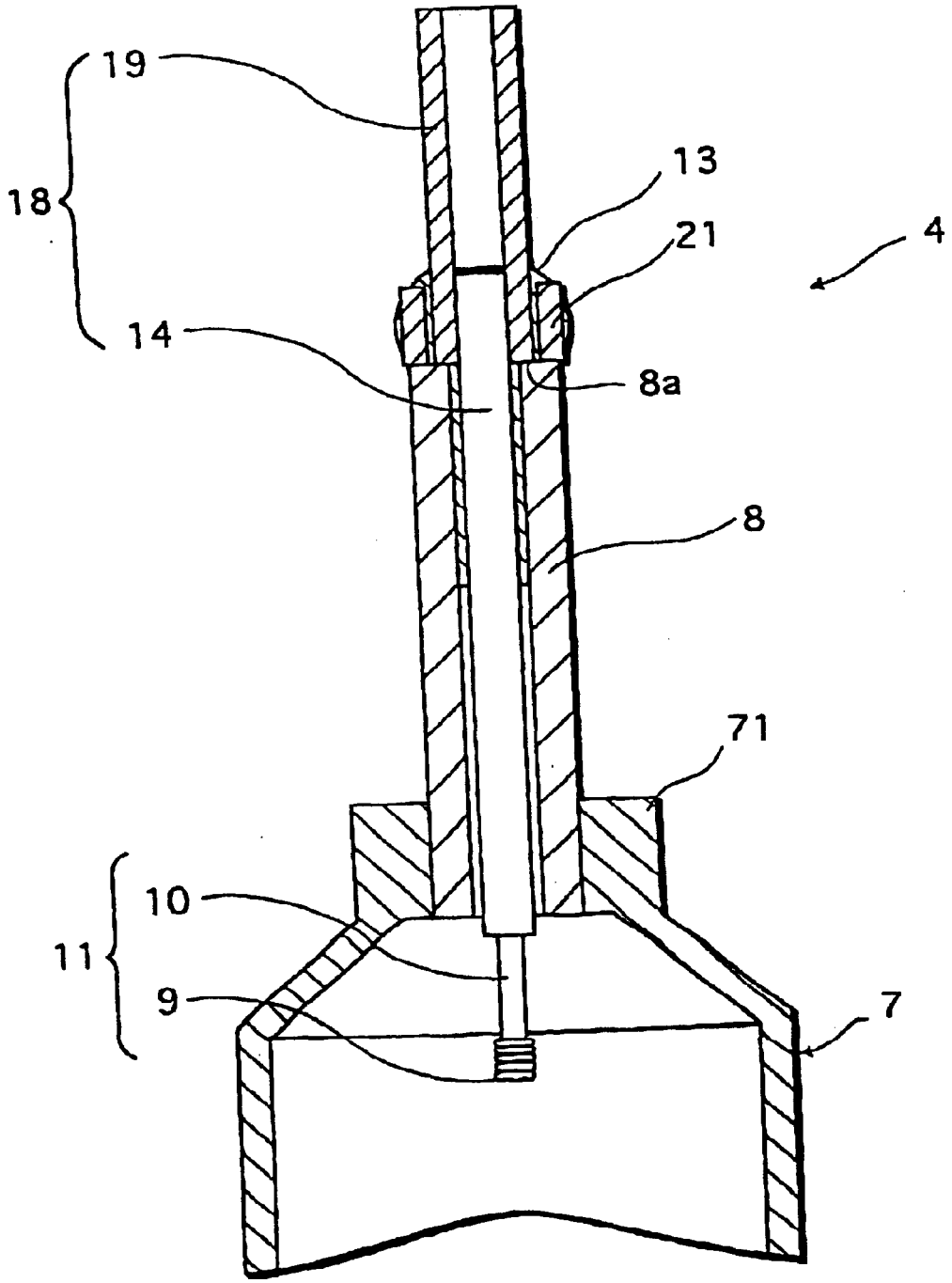
FIG. 10 is an enlarged view in cross section of main parts of a modified arc tube related to the third embodiment.

Though only one end of the arc tube 4 is illustrated in FIG. 10, the other end has the same construction.

(Fourth Embodiment)

Figure 11:
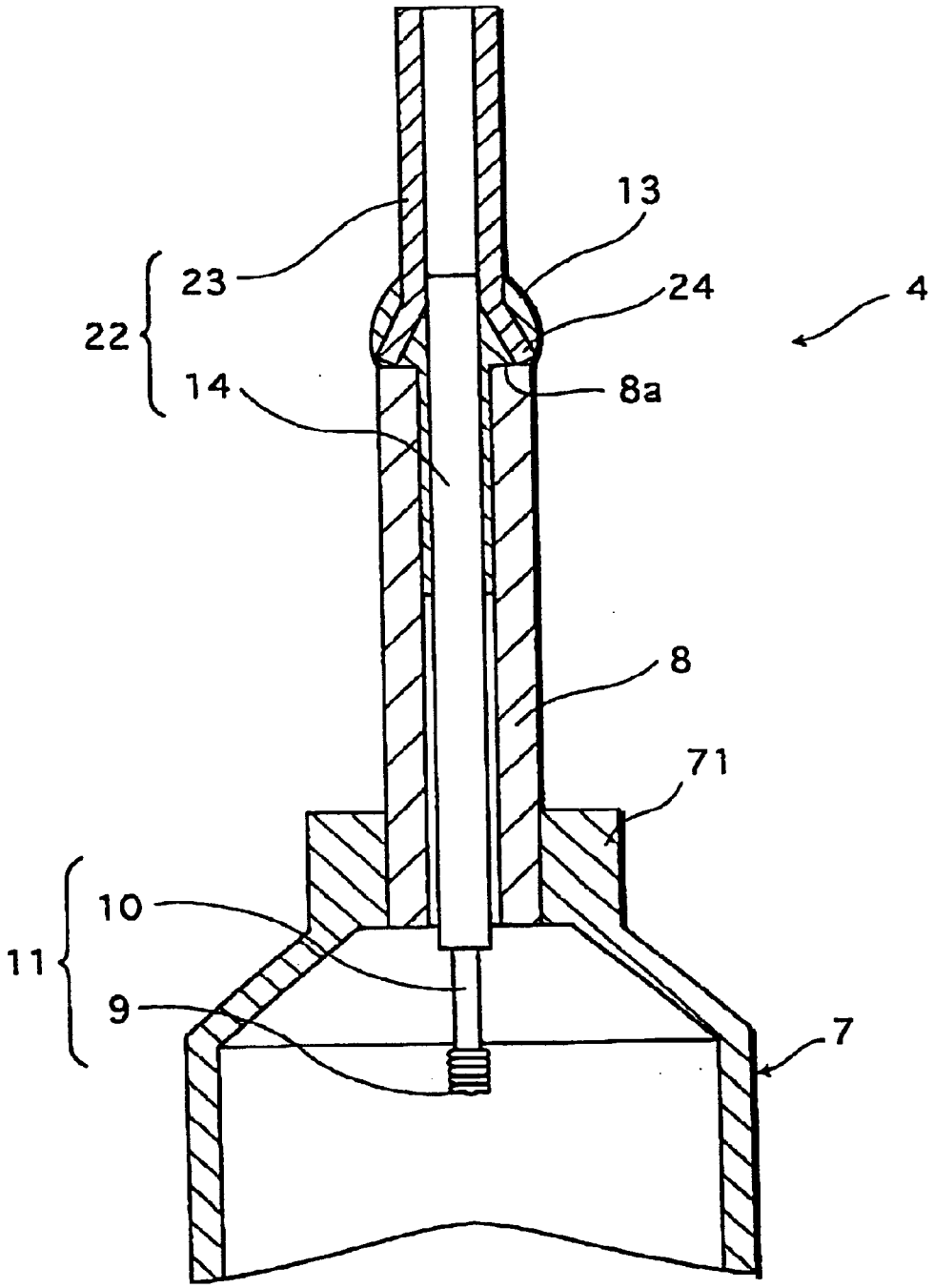
FIG. 11 is an enlarged view of main parts of an arc tube included in a metal halide lamp of the fourth embodiment.

FIG. 11 shows the construction of the capillary tube part 8 of the arc tube 4 in a metal halide lamp, which is the fourth embodiment.

As shown in FIG. 11, the fourth embodiment differs from the second and the third embodiments in that a taper 24 is provided at the end of the cylindrical second conductive member 23 of the feeder 22, and the end of the taper 24 is substantially connected to the end surface of the capillary tube part 8.

The taper 24 flares outwardly (towards the capillary tube part 8), so that the inner rim of the taper 24 contacts the end surface of the capillary tube part 8 in the form of a line.

The seal member 13 is supplied in a space between the first conductive member 14 and the taper 24 of the second conductive member 23.

The other end of the arc tube 4 has the same construction.

The metal halide lamp having the arc tube 4 with the stated construction can provide similar effects to those in the second embodiment; the metal halide lamp can operate for a longer lifetime and acquire stronger resistance to impact. Moreover, since the taper 24 is provided at the end of the second conductive member 23 and substantially contacts to the end surface of the capillary tube part 8, there is little possibility that the breakage of the feeder 22 occurs due to impact and vibration which are caused in a direction perpendicular to the longitudinal direction of the second conductive member 23. This gives the metal halide lamp more resistance to impact.

(Fifth Embodiment)

Figure 12:
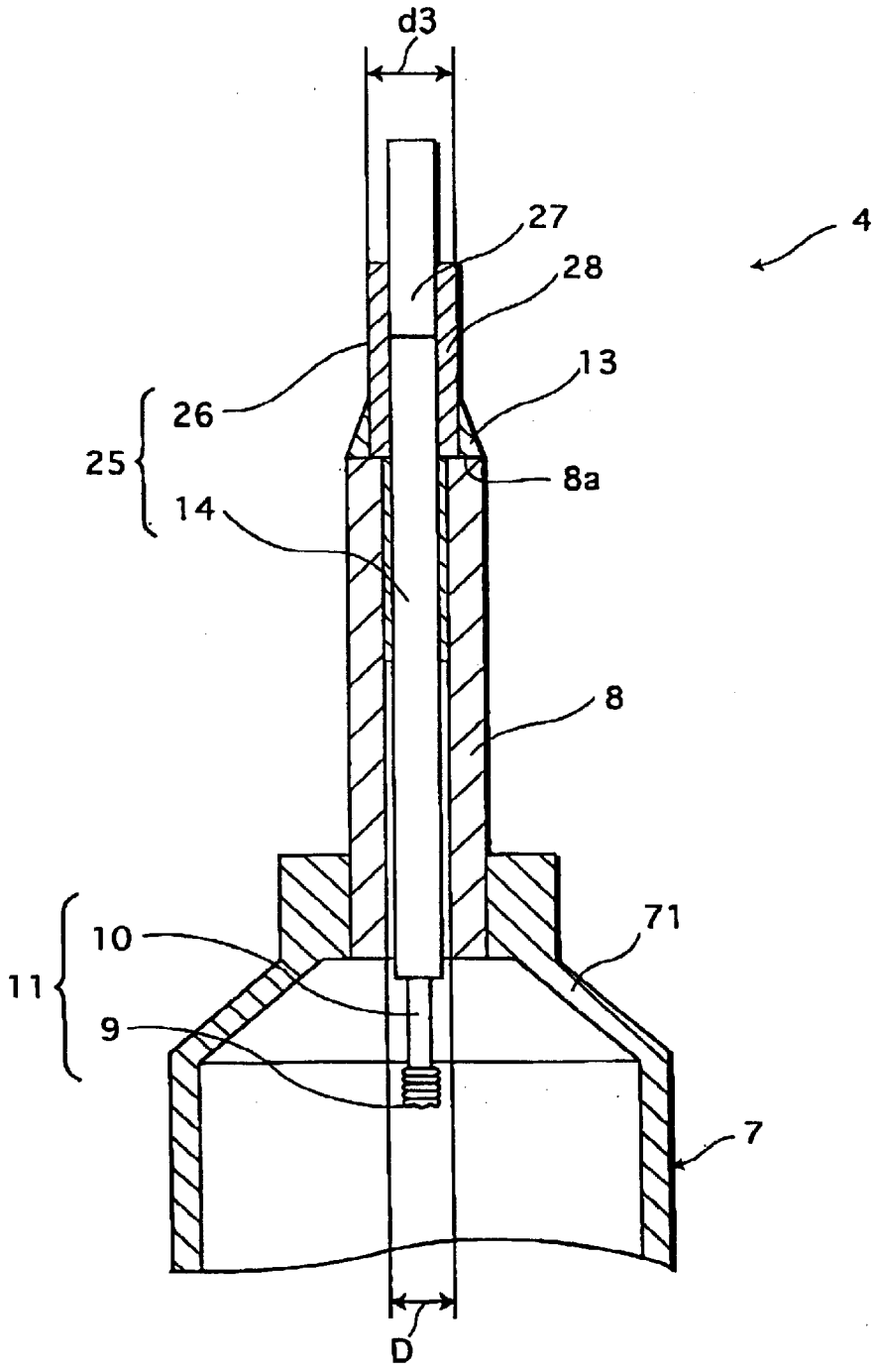
FIG. 12 is an enlarged view in cross section of an arc tube included in a metal halide lamp of the fifth embodiment.

FIG. 12 shows the construction of the capillary tube part 8 of the arc tube 4 of a metal halide lamp, which is the fifth embodiment.

Referring to FIG. 12, the second conductive member 26 of the feeder 25 includes a cylindrical part 28 which is made of niobium and has an inner diameter of 0.94 mm, and a rod part 27 which is made of niobium and inserted from the above and connected to the cylindrical part 28. Other than that, the arc tube 4 of the present embodiment is no different from that of the second embodiment.

The rod part 27 of the second conductive member 26 is inserted into the cylindrical part 28 from the above to reach around the middle, so as to contact the end surface of the first conductive member 14. The first conductive member 14 is inserted at about 3 mm away from the bottom of the cylindrical part 28. They are connected together into a rod. The first conductive member 14 and the second conductive member 26 are mechanically and electronically connected together by laser welding or resistant welding, which is performed on a specific area of the exterior of the cylindrical part 28 corresponding to the place where the first and second conductive members make contact. The capillary tube part 8 on the other end of the arc tube 4 has the same construction.

Note that the expression 'the connecting portion where the first conductive member is connected to the second conductive member' refers not only to an area where they are actually mechanically connected by laser welding or resistant welding, but also an area where they contact with each other. In the latter case, the connecting portion is partially covered by the seal member 13 of FIG. 12.

In this embodiment, too, the bottom surface of the cylindrical part 28 substantially contacts to the end surface 8*a* of the capillary tube part 8. It is preferable that the inner diameter D(mm) of the capillary tube part 8, and the outer diameter d3 (mm) of the cylindrical part 28 satisfy, d3>D In this way, the second conductive member 26 can be used as a stopper to determine the location of the electrode 11 in the main tube part 7 during the manufacture. This saves the need to provide an additional stopper to the feeder which is required by a conventional manufacturing method. This contributes to a reduction in production cost and an increase in production efficiency.

In the present embodiment, the inner diameter D of the capillary tube part 8 is set at 1.0 mm, and the outer diameter of the cylindrical part 28 is set at 1.4 mm, so as to satisfy the above requirement.

The metal halide lamp having the arc tube 4 with the stated construction can provide the same effects as the metal halide lamp of the second embodiment, increasing the operating life and resistance to impact.

Furthermore, the end surface of the first conductive member 14 contacts to the end surface of the rod part 27, so that the contact area where the two members contact with each other increases in size, which ensures the electrical connection of them.

In the second and fourth embodiments, the entire part of the second conductive member has a cylindrical shape, but a second conductive member may have a rod-like form if a connecting portion where the second conductive member is connected to the first conductive member 14 inserted has a cylindrical shape.

The cylindrical part 28 of the fifth embodiment is made of niobium, but the same effects can be obtained when using a different material for the cylindrical part 28, including tantalum and molybdenum. It is not necessary that an identical material should be used for the rod part 27 and cylindrical part 28, as in the fifth embodiment.

(Sixth Embodiment)

In the embodiments 1 to 5, the first conductive member and the second conductive member, included in the feeder, are connected together so that their respective longitudinal axis centers correspond or are arranged side by side. In the sixth embodiment, they are connected and cross at a right angle. Other than that, a metal halide lamp of the sixth embodiment has the same construction as the embodiments 1 to 5.

Figure 13:
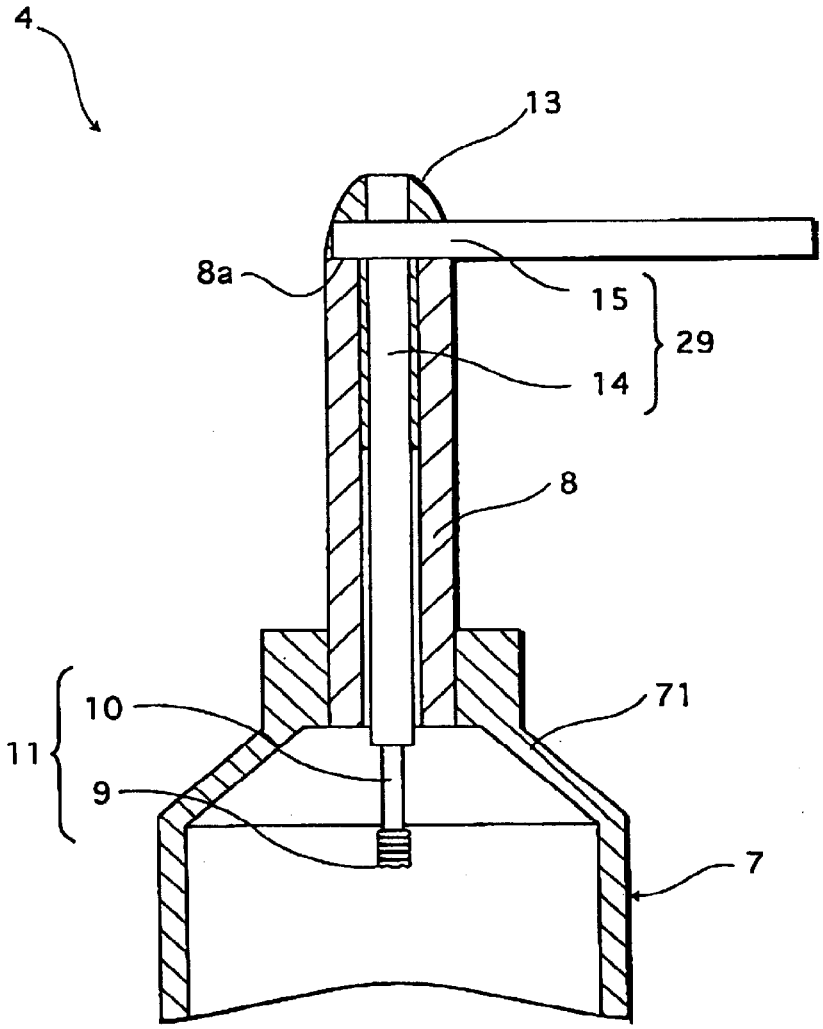
FIG. 13 is an enlarged view in cross section of main parts of an arc tube included in a metal halide lamp of the sixth embodiment.

FIG. 13 is an enlarged cross-sectional view illustrating the construction of a capillary tube part 8 of the arc tube 4 in the metal halide lamp of the sixth embodiment.

Referring to FIG. 13, a feeder 29 includes a first conductive member 14 arranged inside the capillary tube part 8 and a second conductive member 15 placed perpendicular to the axial direction of the first conductive member 14. The end of the second conductive member 14 is connected to a protruding part of the first conductive member 14 that is protruding from the capillary tube part 8. Note that the other end of the arc tube 4 has the same construction.

Having the arc tube 4 with the stated construction, the metal halide lamp of the sixth embodiment can operate for a longer lifetime and acquire a greater resistance to impact, as in the case of the other embodiments. Besides, the first conductive member 14 and the second conductive member 15 are connected so that the longitudinal axis of the second conductive member 14 is positioned perpendicular to the longitudinal axial center of the second conductive member 15. As a result, a shorter metal halide lamp is obtained, which is shorter than the metal halide lamp of the first embodiment, where the end of the first conductive member 14 and the end of the second conductive member 15 are arranged side by side.

Also, the second conductive member 15, being substantially in contact with the end of the capillary tube part 8, serves as a stopper to determine the location of the electrode 11.

Modifications

Though the high-pressure discharge lamp of the present invention has been described based on the above embodiments, the invention should not be limited to such. For example, the following modifications are possible.

(1) Though a conductive cermet is used as a material for the first conductive member 14 in the above embodiments, it may be replaced with a different conductive substance if the substance is resistant to halides and has a thermal expansion coefficient closer to that of frit glass which is used for the seal member. It is more preferable that the thermal expansion coefficient of the substance should be at least at the same level as that of tungsten, and more preferably closer to that of frit glass.

For the second conductive member 15, it is necessary to employ a material that has a greater mechanical strength than the first conductive member leastwise, and a great mechanical strength especially against a bending impact. Also, the material should preferably have a thermal expansion coefficient approximate to that of the seal member. Such materials include tantalum, titanium, molybdenum and zirconium, in addition to niobium described above.

As a material for the second conductive member 15, any substance may be employed on condition that it is more flexible than the first conductive member, in addition to/instead of the requirement that it has a greater mechanical strength than the second conductive member 15. Elastic materials such as a spring and conductive materials such as stranded wires may be used as a flexible material.

Such material can absorb external impact, and thus prevents breakage of the lamp at a place where the material is used. This gives the lamp greater resistance to impact.

(2) In the above embodiments 1 to 6, the first conductive member 14 and the second conductive member 15, 17, 17*a*, 19, 23 and 26 each consist of a single member. However, they may be made up of a plural of members connected in a unified form.

In such a case, it is preferable that a material for the first conductive member should be conductive and resistant to halides, and has a thermal expansion coefficient approximate to those of the seal member and the capillary tube part at least in an area where it contacts to the seal member 13. It is also preferable that a material for the second conductive member should have a greater mechanical strength than the first conductive material, or is flexible and has a thermal expansion coefficient approximate to that of the seal member at least in an area where it contacts to the seal member 13 and is fixed therewith.

(3) In the embodiments 1 to 6, the feeders of the same construction are included and sealed with the seal member 13 in both of the capillary tube parts 8, which are selected out of the feeders 12, 16, 18, 22, 25 or 29. However, the same effects can be achieved by using in combination any two feeders in the metal halide lamps of the embodiments 1 to 6. These feeders are selected out of the feeders 12, 16, 18, 22, 25 and 29, and each of them has a different construction.

Also, a conventional feeder may be used in one of the capillary tube parts if the other capillary tube part is constructed as described in any of the above embodiments. In this case, too, the possibility of the metal halide lamp being broken is less likely than when using conventional feeders in both capillary tube parts.

(4) The present invention may also be realized by a combination of any of the above embodiments.

Figure 6:
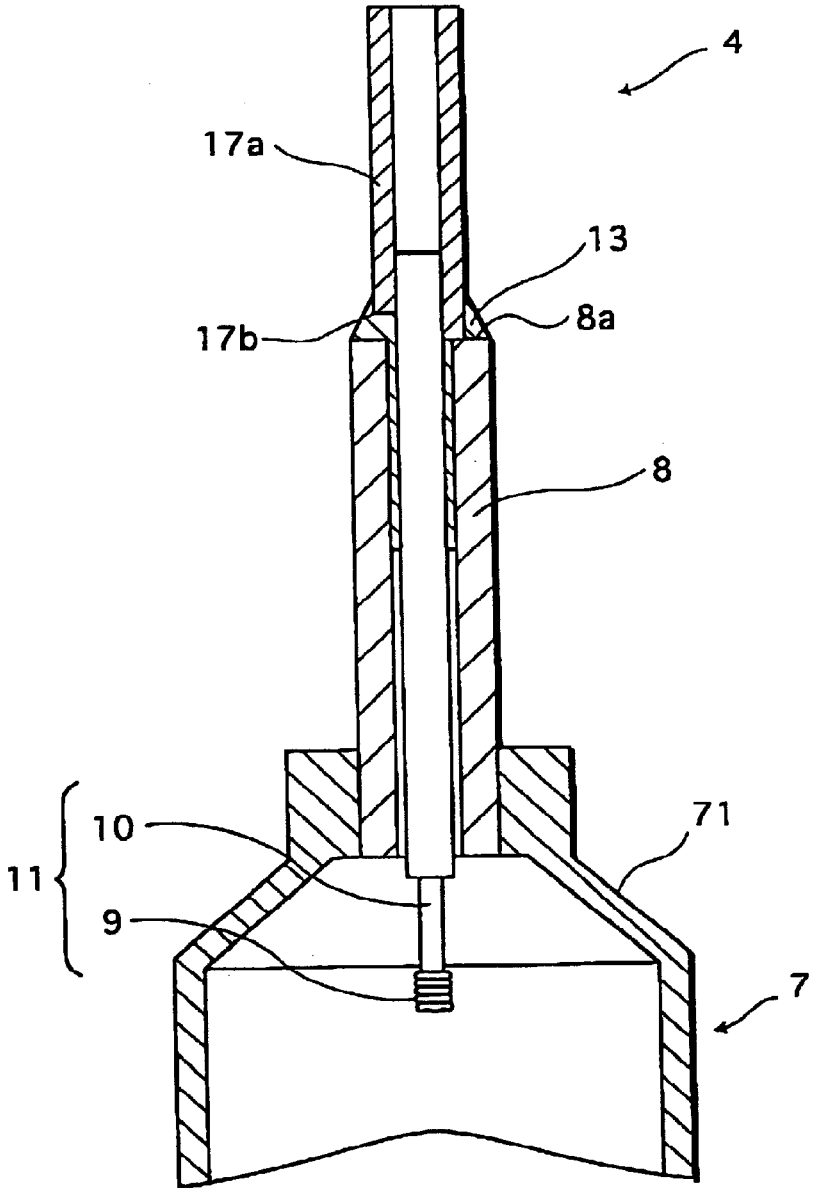
FIG. 6 is an enlarged view in cross section of main parts of a modified arc tube of the second embodiment.

For instance, the incision part 17*b* (See FIG. 6 and FIG. 7) may be provided at the cylindrical second conductive member 17*a* in the embodiments 3 to 5, as is provided at the bottom of the second conductive member 17*a* in the second embodiment.

(5) Though the metal halide lamps with a rated wattage of 150 W are demonstrated in the embodiments 1 to 6, the present invention may be applicable to a metal halide lamp with a rated wattage of 70 W, 250 W or 400 W, and to a high-pressure discharge lamp, including a high-pressure sodium lamp.

The size of the construction elements of the above embodiments is merely an example, and may be changed according to the design.

(6) In the above embodiments, the metal halide lamps are constructed so that the connecting portion where the first conductive member is connected to the second conductive member is arranged in the vicinity of the end of the capillary tube part, and that the connecting portion is covered with the seal member at the time of enclosing. As a result, the connecting portion is reinforced by the seal member, and the second conductive member is fixed securely at the end of the capillary tube part. This is advantageous because the connecting portion is both sealed and reinforced at a time. However, with respect to the reinforcement, it is possible to improve lamp's resistance to impact if at least the second conductive member is properly fixed to the capillary tube part 8. For the fixation, the fixing member may be replaced with another substance, other than the seal member, that has (a) a melting point lower than those of the arc tube vessel and the feeder, and higher than a temperature at the end of the capillary tube part during the usual operation, and (b) a thermal expansion coefficient approximate to that of the capillary tube part.

(7) Though any of the arc tube in the above embodiments is constructed so that the substantially cylindrical main tube part is connected to the capillary tube parts, it may well be that the arc tube may be a tube having a wide section and narrow sections.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A high-pressure discharge lamp having an arc tube, the arc tube comprising:

an arc vessel including a main tube part and a pair of capillary tube parts, the main tube part having an inner discharge space, the capillary tube parts continuing into the discharge space;

a pair of electrodes being opposed to each other in the discharge space;

a pair of feeders, each of which is inserted through a different one of the capillary tube parts with an end connected to one of the electrodes on a side of the feeder and a remaining end protruding from the capillary tube part to outside; and a seal member for sealing the feeders in the capillary tube parts, wherein at least one of the feeders includes a first conductive member being sealed in the capillary tube part and a second conductive member being connected to the first conductive member outside the capillary tube part, the first conductive member being resistant to halides, the second conductive member being located wholly outside of the capillary tube part and fixed with a fixing member at an end of the capillary tube part.

2. The high-pressure discharge lamp of claim 1, wherein the second conductive member has a greater mechanical strength than the first conductive member.

3. The high-pressure discharge lamp of claim 1, wherein the second conductive member is more flexible than the first conductive member.

4. The high-pressure discharge lamp of claim 1, wherein the fixing member is the seal member.

5. The high-pressure discharge lamp of claim 1, wherein the fixing member is provided so as to at least partially cover a connecting portion where the first conductive member is connected with the second conductive member.

6. The high-pressure discharge lamp of claim 5, wherein the fixing member is provided so as to completely cover a connecting portion where the first conductive member is connected with the second conductive member.

7. The high-pressure discharge lamp of claim 1, wherein a connecting portion where the first conductive member is connected to the second conductive member is provided in a vicinity of the end of the capillary tube part.

8. The high-pressure discharge lamp of claim 1, further comprising:

a ringed member through which the second conductive member is inserted, wherein the ringed member is provided substantially in contact with the end surface of the capillary tube part and fixed to the second conductive member and an end surface of the capillary tube part with the fixing member.

9. The high-pressure discharge lamp of claim 1, wherein a difference in a thermal expansion coefficient between the first conductive member and the seal member is equal to or smaller than a difference in the thermal expansion coefficient between tungsten and the seal member.

10. The high-pressure discharge lamp of claim 1, wherein the second conductive member is chiefly made of niobium.

11. The high-pressure discharge lamp of claim 1, wherein the first conductive member and the second conductive member are connected so that ends of the first conductive member and the second conductive member are placed side by side.

12. The high-pressure discharge lamp of claim 11, wherein an end surface of the second conductive member facing the first conductive member substantially contacts an end surface of the capillary tube part, and an inner diameter D(mm) of the capillary tube part, an outer diameter d1 (mm) of the first conductive member, and an outer diameter d2 (mm) of the second conductive member satisfy, $d1+d2>D$.

13. The high-pressure discharge lamp of claim 1, wherein the first conductive member is connected to the second conductive member so that the first conductive member is arranged perpendicular to the second conductive member longitudinally.

14. The high-pressure discharge lamp of claim 13, wherein the first conductive member is made of a conductive cermet.

15. The high-pressure discharge lamp of claim 1, wherein at least an end of the second conductive member facing the first conductive member has a cylindrical shape, and the first conductive member is inserted into the cylindrical part of the second conductive member to be connected to the second conductive member.

16. The high-pressure discharge lamp of claim 15, wherein a cylindrical end surface of the second conductive member facing the first conductive member is provided substantially in contact with an end surface of the capillary tube part, and an inner diameter D(mm) of the capillary tube part and an outer diameter d3 (mm) of the cylindrical portion satisfy, d3>D.

17. The high-pressure discharge lamp of claim 15, wherein a cylindrical end surface of the second conductive member facing the first conductive member is provided substantially in contact with an end surface of the capillary tube part, and an incision part is provided at an end of the cylindrical part of the second conductive member, the incision part allowing for a connection between an inner space and outside, the inner space being situated between the capillary tube part and the first conductive member.

18. The high-pressure discharge lamp of claim 15, wherein a cylindrical end surface of the second conductive member facing the first conductive member is provided substantially in contact with an end surface of the capillary tube part, and an incision part is provided at an end of the capillary tube part, the incision part allowing for a connection between an inner space and outside, the inner space being situated between the capillary tube part and the first conductive member.

19. The high-pressure discharge lamp of claim 15, wherein a fringe is provided at a cylindrical end of the second conductive member facing the first conductive member, the fringe being placed substantially in contact with an end surface of the capillary tube part.

20. The high-pressure discharge lamp of claim 19, wherein the fringe has a thickness of 0.2 mm to 1.0 mm.

21. The high-pressure discharge lamp of claim 15, wherein a taper is provided at the cylindrical end of the second conductive member facing the first conductive member, the taper flaring towards the first conductive member, an end of the taper substantially contacts to an end surface of the capillary tube part.

22. An arc tube, comprising:

an arc vessel including a main tube part and a pair of capillary tube parts, the main tube part having an inner discharge space, the capillary tube parts continuing into the discharge space;

a pair of electrodes being opposed to each other in the discharge space:

a pair of feeders, each of which is inserted through a different one of the capillary tube parts with an end connected to one of the electrodes on a side of the feeder and a remaining end protruding from the capillary tube part to outside; and a seal member for sealing the feeders in the capillary tube parts, wherein at least one of the feeders includes a first conductive member being sealed in the capillary tube part and a second conductive member being connected to the first conductive member outside the capillary tube part, the first conductive member being resistant to halides, the second conductive member being located wholly outside of the capillary tube part and fixed with a fixing member at an end of the capillary tube part.

23. An illumination device comprising:

an arc vessel including a main tube having an inner discharge space, and a first capillary tube and a second capillary tube, each capillary tube continuing into the discharge space;

a first electrode and a second electrode being opposed to each other in the discharge space;

a first conductive member extending through the first capillary tube and coupled to the first electrode at a first end; and a second conductive member coupled to a second end of the first conductive member and located wholly outside the capillary tube.

24. The illumination device of claim 23 wherein the first conductive member is resistant to halides and sealed in the capillary tube.

25. A method of manufacturing an illumination device comprising:

forming an arc vessel including a main tube having an inner discharge space, and a first capillary tube and a second capillary tube, each capillary tube continuing into the discharge space;

positioning a first electrode and a second electrode opposite to each other in the discharge space;

positioning a first conductive member through the first capillary tube;

coupling the first conductive member to the first electrode at a first end; and coupling a second conductive member to a second end of the first conductive member, the second conductive member being wholly outside the first capillary tube.

26. The method of manufacturing an illumination device of claim 25 wherein the first conductive member is resistant to halides and sealed in the capillary tube.

* * * * *